US007152376B2

(12) United States Patent
Wyatt

(10) Patent No.: US 7,152,376 B2
(45) Date of Patent: Dec. 26, 2006

(54) GUTTER EMPTYING SYSTEM

(76) Inventor: Chris Roger Wyatt, 30832 Piney La., Ocean View, DE (US) 19970

( * ) Notice: Subject to any disclaimer, the term of this patent is extended or adjusted under 35 U.S.C. 154(b) by 313 days.

(21) Appl. No.: 10/909,201

(22) Filed: Jul. 29, 2004

(65) Prior Publication Data

US 2006/0032151 A1 Feb. 16, 2006

(51) Int. Cl.
*E04D 13/072* (2006.01)

(52) U.S. Cl. ..... 52/11; 248/48.2

(58) Field of Classification Search ..... 52/11, 52/12, 13, 14, 15, 16; 248/48.1, 48.2
See application file for complete search history.

(56) References Cited

U.S. PATENT DOCUMENTS

| | | | | | |
|---|---|---|---|---|---|
| 4,014,074 | A | * | 3/1977 | Faye | 16/392 |
| 4,745,657 | A | * | 5/1988 | Faye | 16/226 |
| 5,274,965 | A | * | 1/1994 | Jackson | 52/11 |
| 5,335,460 | A | * | 8/1994 | Smith, Jr. | 52/11 |
| 5,649,681 | A | * | 7/1997 | Faye | 248/48.1 |
| 5,989,357 | A | * | 11/1999 | Vilhauer et al. | 134/8 |

* cited by examiner

*Primary Examiner*—Lanna Mai
*Assistant Examiner*—Christine T. Cajilig

(57) ABSTRACT

This invention permits use of a conventional rain gutter system and downspout, and other gutter profiles as described to be converted into a dumpable rain gutter system which can be easily cleaned. This low profile gutter tilting system, which has few moving parts, low noise level, and no unsightly housing or exposed parts, comprises a plurality of gutter supports. This system uses air or liquid as a means to activate a rotating mechanism concealed inside the supports to pivot the gutter about a common point, as to empty any debris not normally washed out of a downspout or gutter system. The system includes, in general an OG type gutter, and a gutter support, which mounts to a building facia or trim board. The gutter supports include a hinge where a first free end is connected to the back bottom edge of a gutter, and a second free end of the hinge is connected to a stationary housing that mounts to the facia board and supports a gutter. The front bottom edge is pivotally connected to the stationary housing. An inflatable device in the stationary housing is placed between the hinge and the stationary housing to pivot the hinge, thereby lifting the rear of the gutter due to the front edge being pivotally connected to the stationary housing until the hinge is fully open, emptying the gutter of debris. A weight is affixed to the first free end of the hinge whereby the gutter, after emptying, will be partially retracted to it's water and debris collecting position by the resiliency of the inflatable device or bladder, and fully retracted by the pull of the weight, and or the vacuum created by the drainage of liquid from the system when a liquid is used as the inflatable means.

11 Claims, 9 Drawing Sheets

GUTTER EMPTYING SYSTEM

BACKGROUND OF THE INVENTION

The present invention relates to a gutter system for collecting rain and, incidentally, debris from trees and emptying any debris not normally washed out of a downspout, and in particular, to a gutter and gutter emptying system.

It is well known that gutters collect water, rain or snow, and dispense it through a downspout. It is also known to pivot or rotate the gutter to empty any debris from trees, such as leaves and twigs. The patented art clearly exhibited several systems for emptying debris. One popular system includes a support mounted to a fascia board and pivotally connected to the bottom front edge of a gutter to pivot about the front edge, U.S. Pat. No. 5,649,681 to Fave, for example. Another popular system also provides a pivotal support, however the gutter pivots about the bottom back edge (see U.S. Pat. No. 5,417,015 Coyne). There is also a body of art where a gutter is rotatably mounted on a shaft, for example, U.S. Pat. No. 4,061,151 to Ward.

The prior art all use some type of pivoting systems, everything from a pulley and chain to a crank and pitman. These systems may function well, however, they are eyesores with chains, pulleys, and levers either exposed or in some cumbersome housing. The present invention provides a low profile gutter tilting system which has few moving parts, a low noise level and no unsightly housing or exposed parts.

BRIEF DESCRIPTION OF THE INVENTION

The invention relates to a building gutter system for collecting rain water, leaves, etc. and emptying any collected debris from a gutter. The present building gutter system includes a gutter, in general an OG type gutter, and a gutter support which mounts to a building facia board. The gutter supports include a hinge where a first free end is connected to the back bottom edge of a gutter and a second free end of the hinge is connected to a stationary housing that mounts to the facia board and supports a gutter. The front bottom edge is pivotally connected to the stationary housing. An inflatable device in the stationary housing is placed between the hinge and the stationary housing to pivot the hinge thereby lifting the rear of the gutter due to the front edge being pivotally connected to the stationary housing until the hinge is fully or almost fully open, emptying the gutter of debris. A weight is affixed to the first free end of the hinge, whereby the gutter after emptying, will be partially retracted to it's water and debris collecting position by the resiliency of the inflatable device or bladder, and fully retracted by the pull of the weight, and the vacuum created by the drainage of liquid from the system when a liquid is used as the inflatable means.

DESCRIPTION OF THE INVENTION

Figure 1:
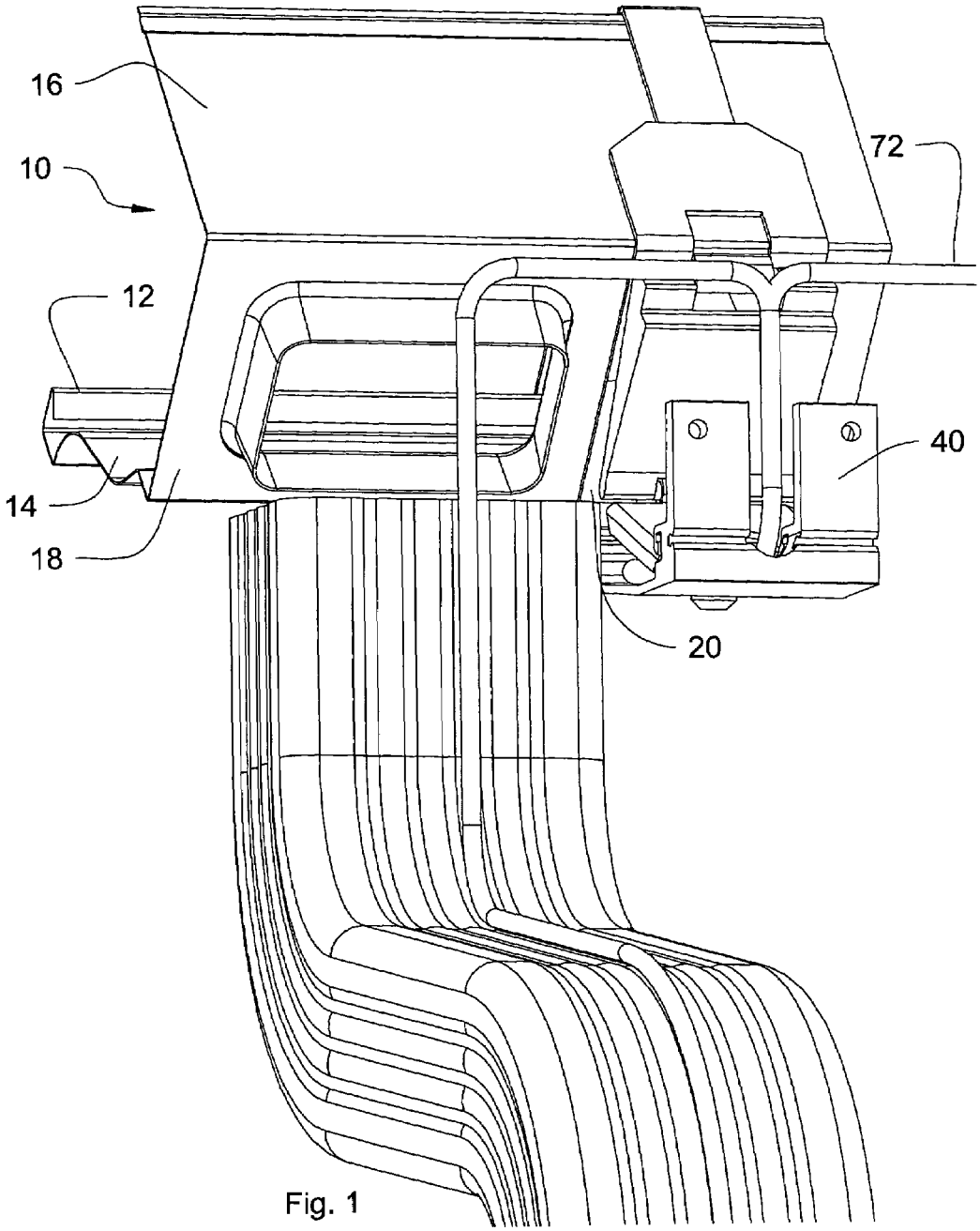
Figure 2:
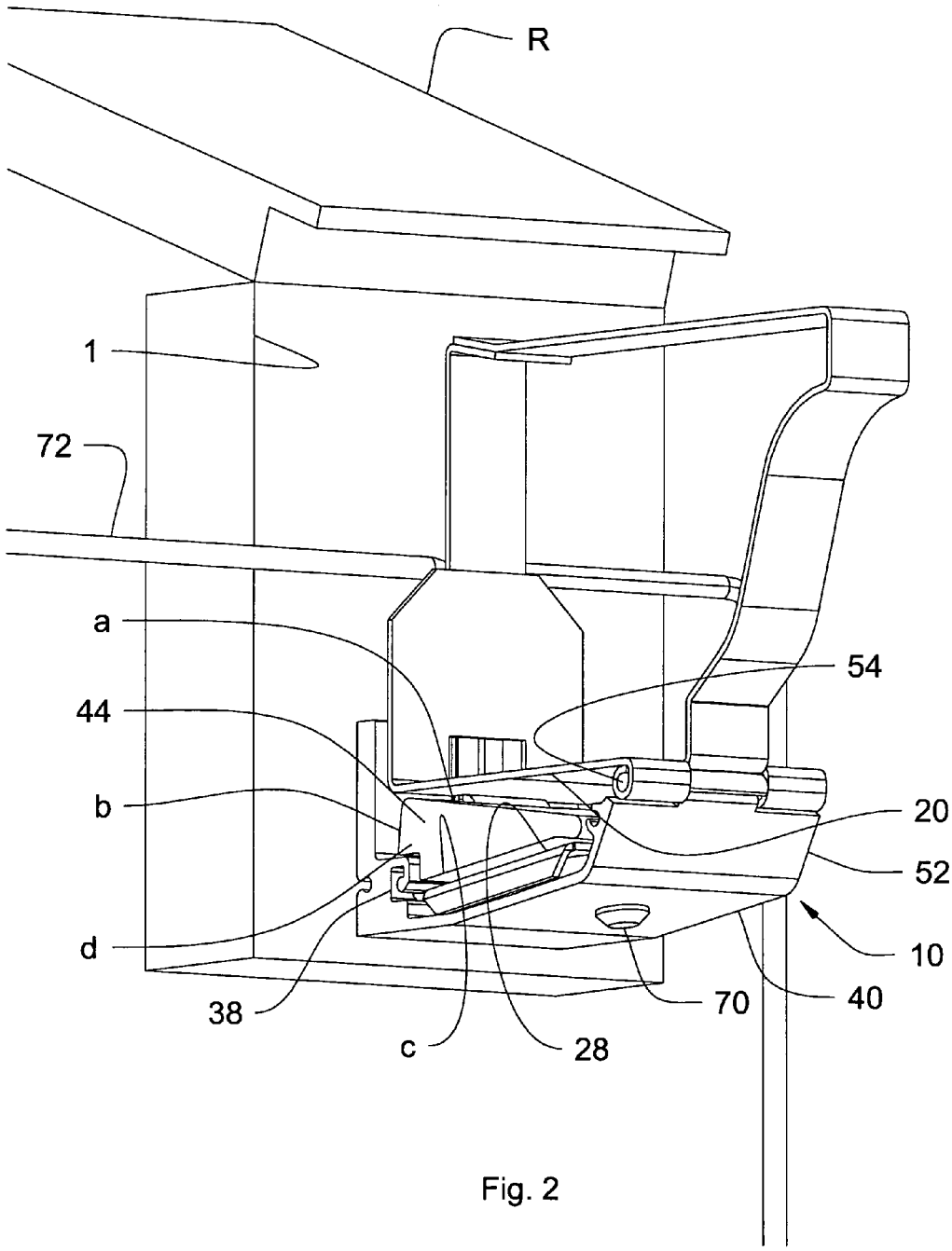
Figure 3:
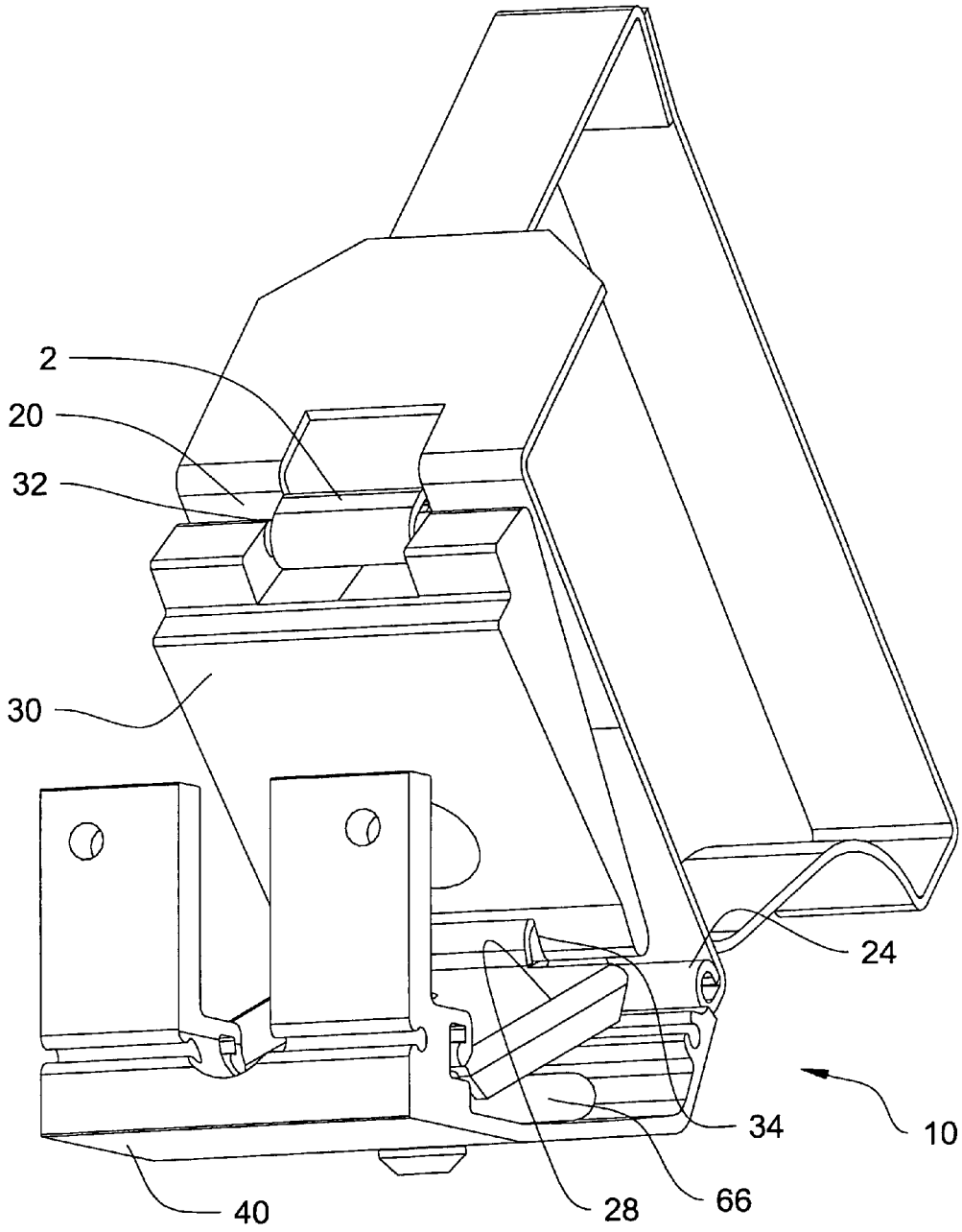
Figure 4:
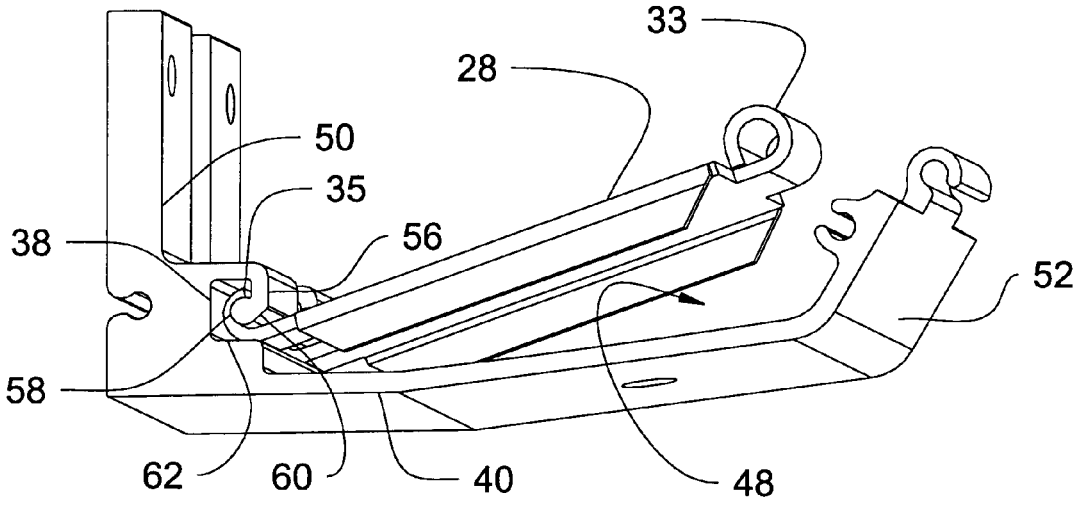
Figure 5:
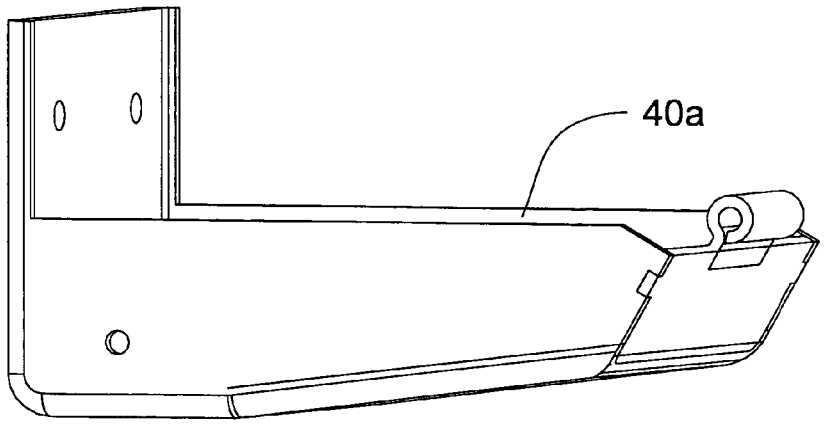
Figure 6:
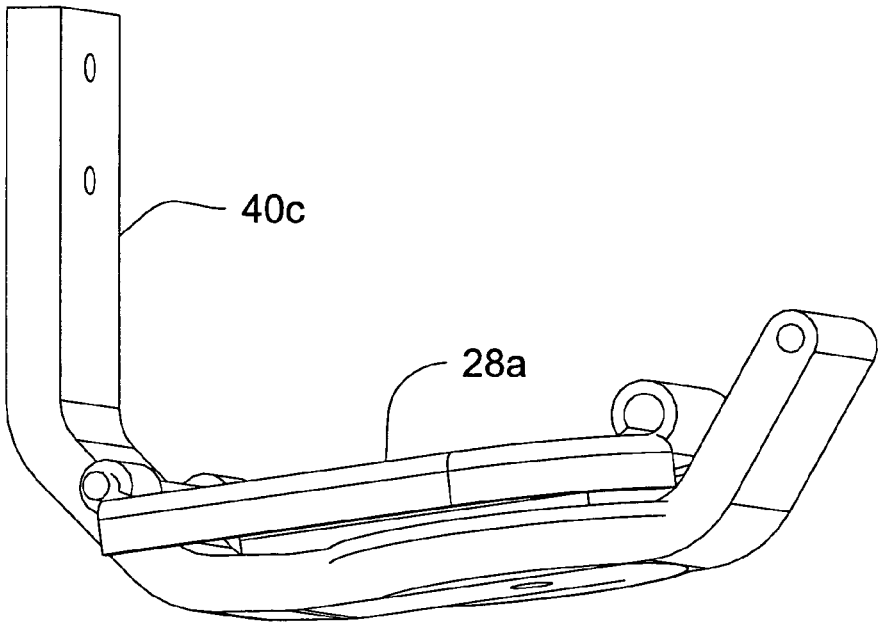
Figure 7:
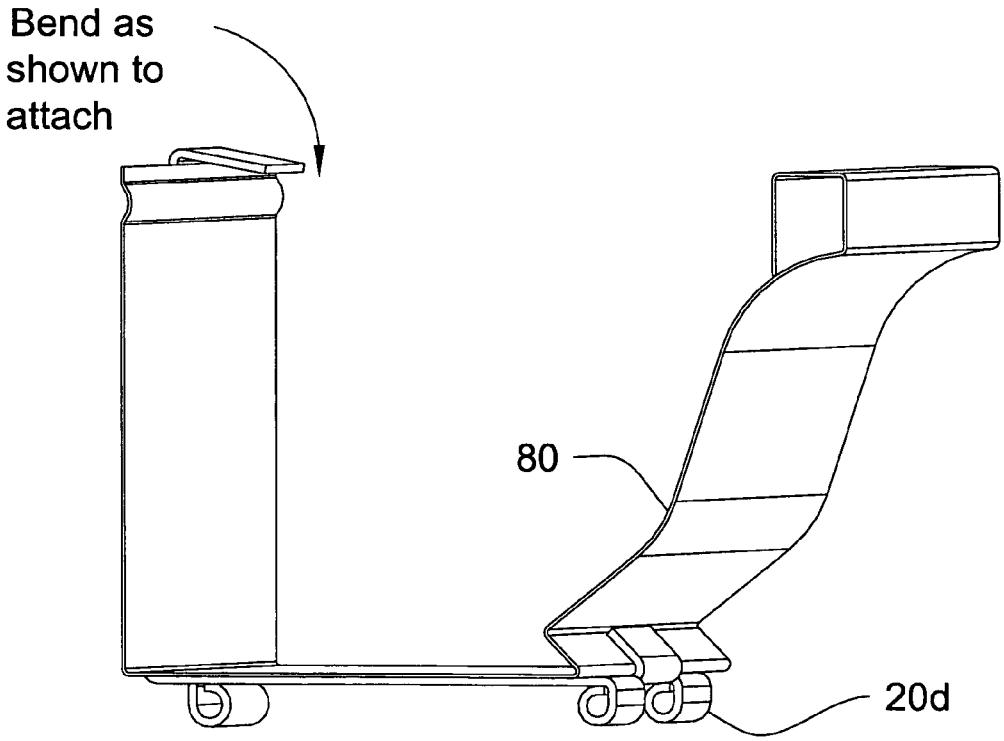
Figure 8:
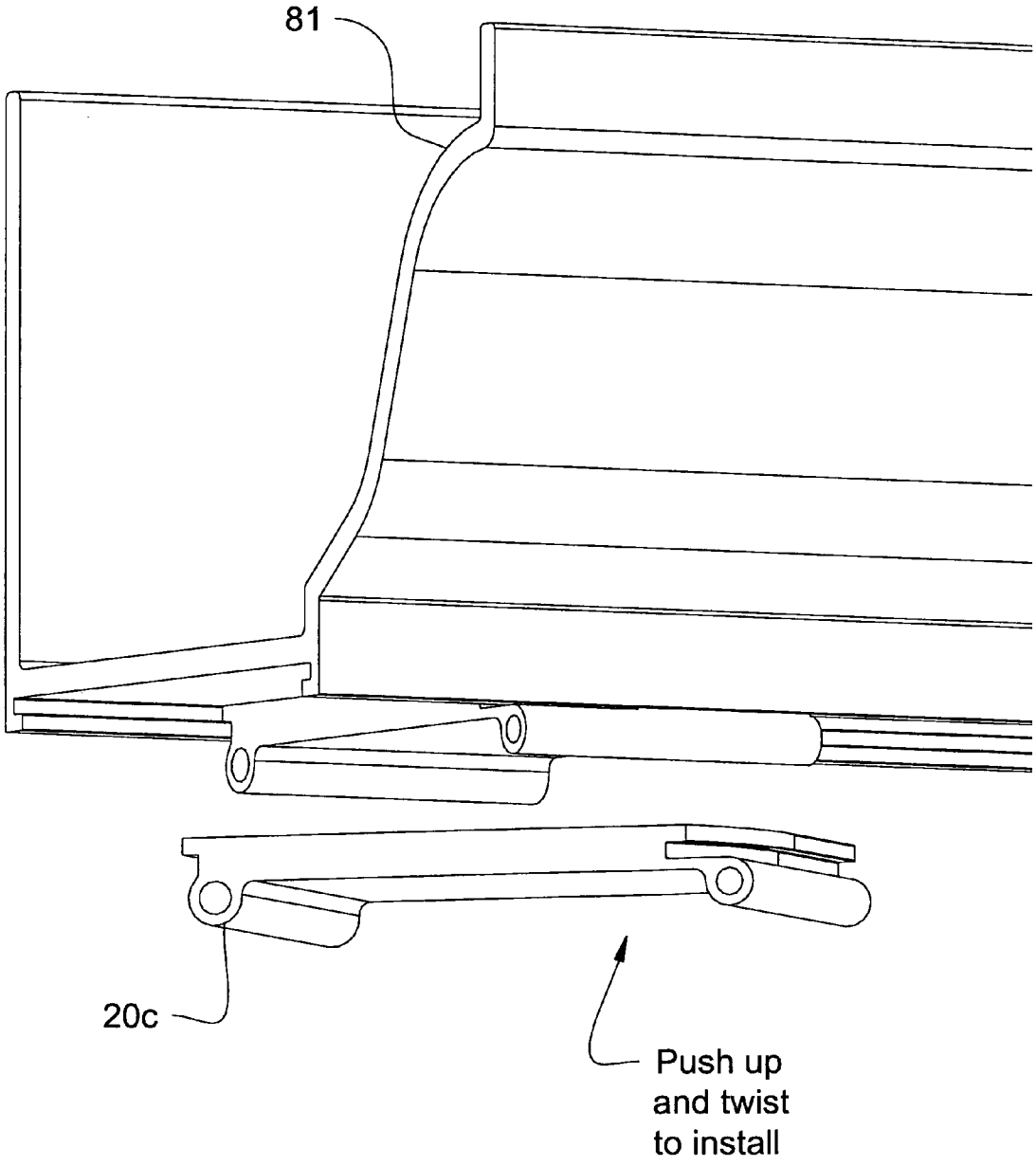
Figure 9:
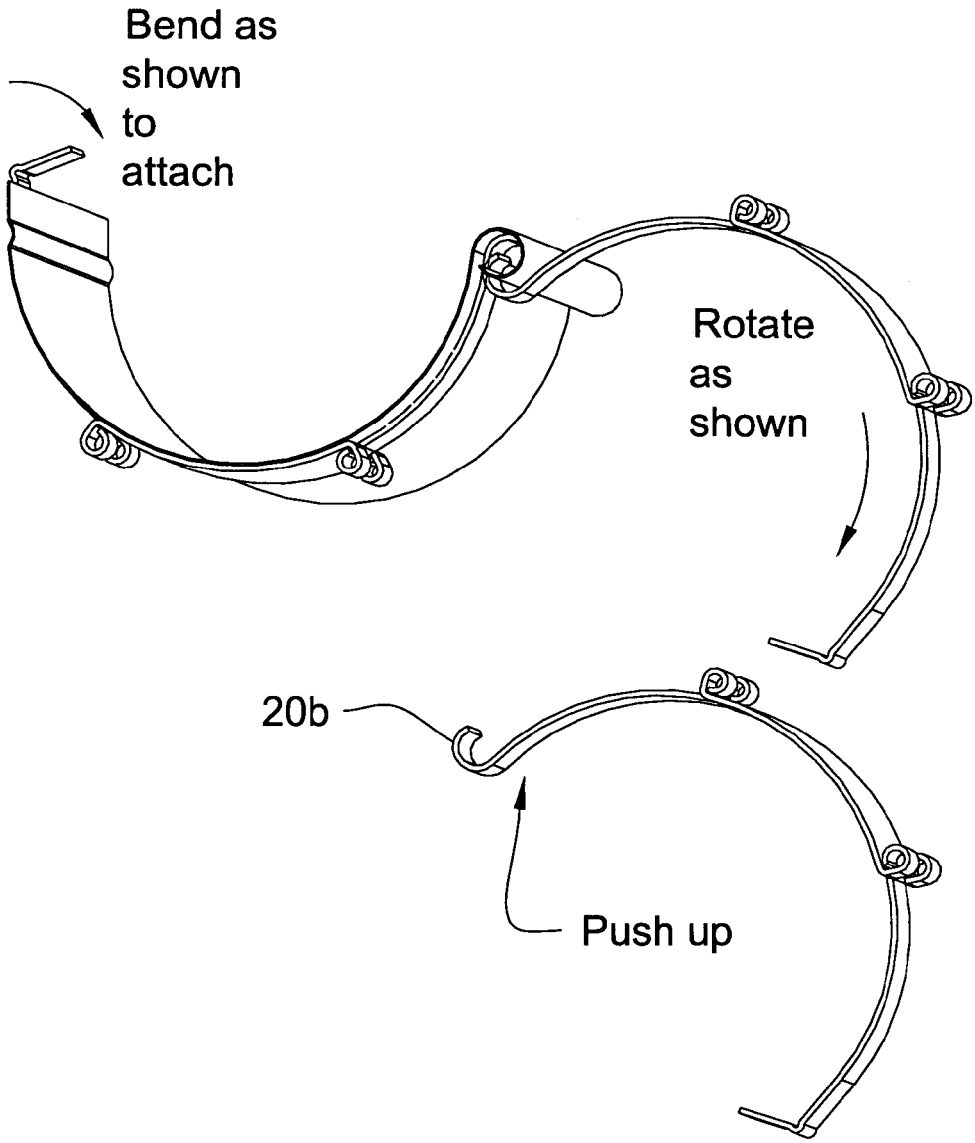
Figure 10:
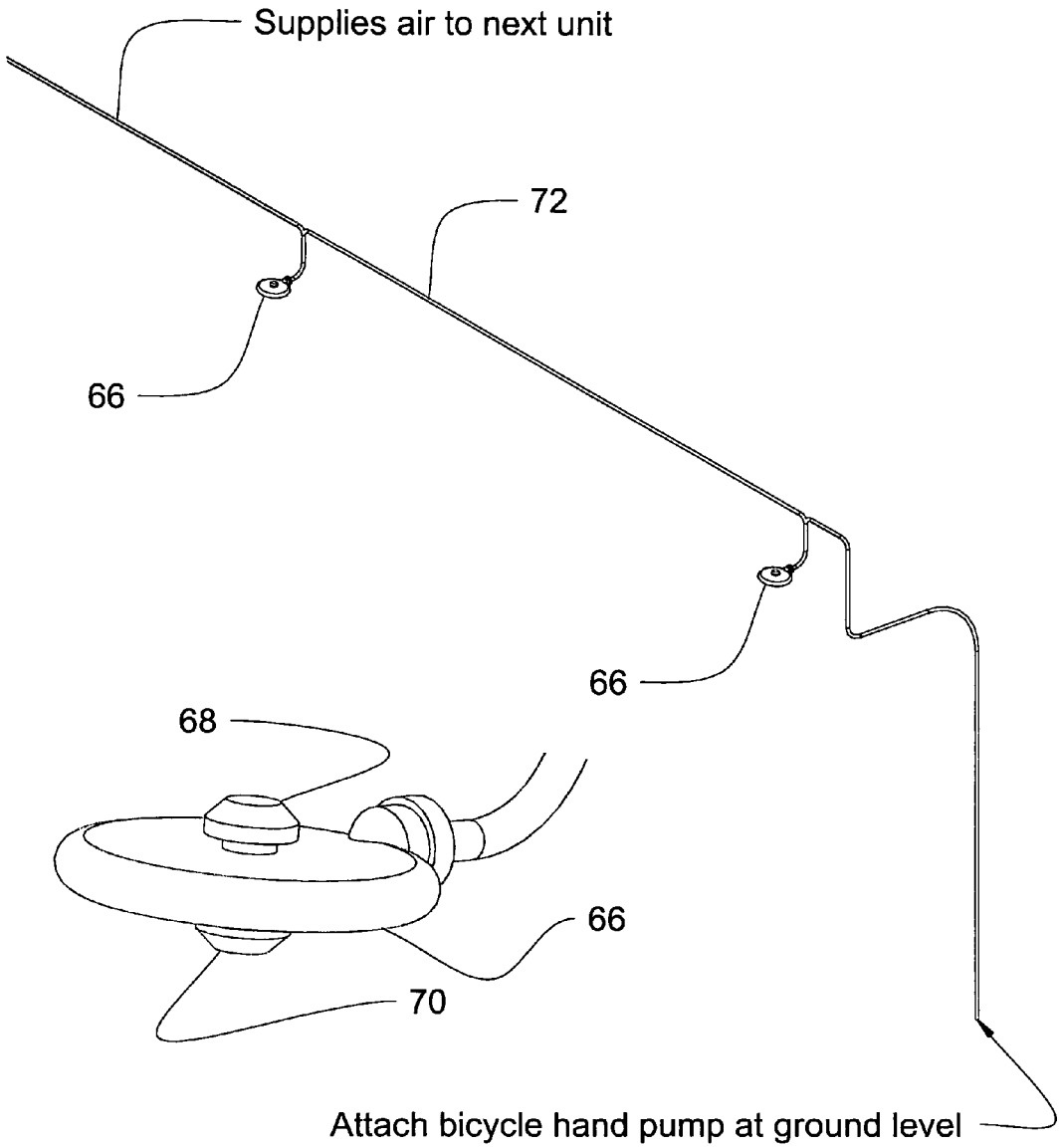
Figure 11:
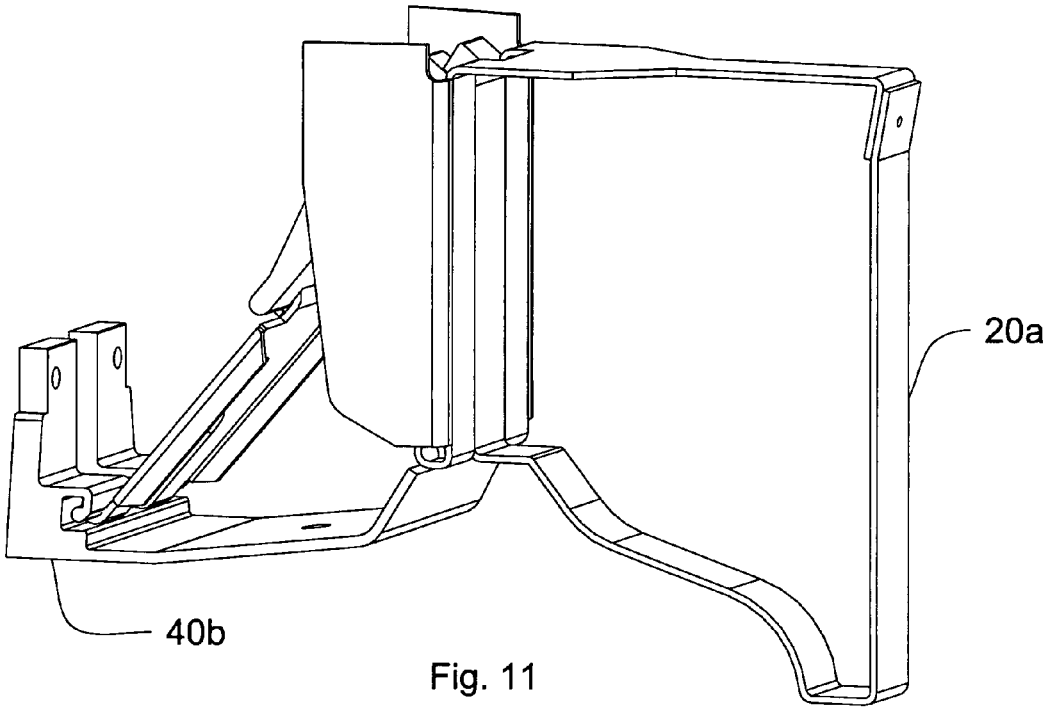
Figure 12:
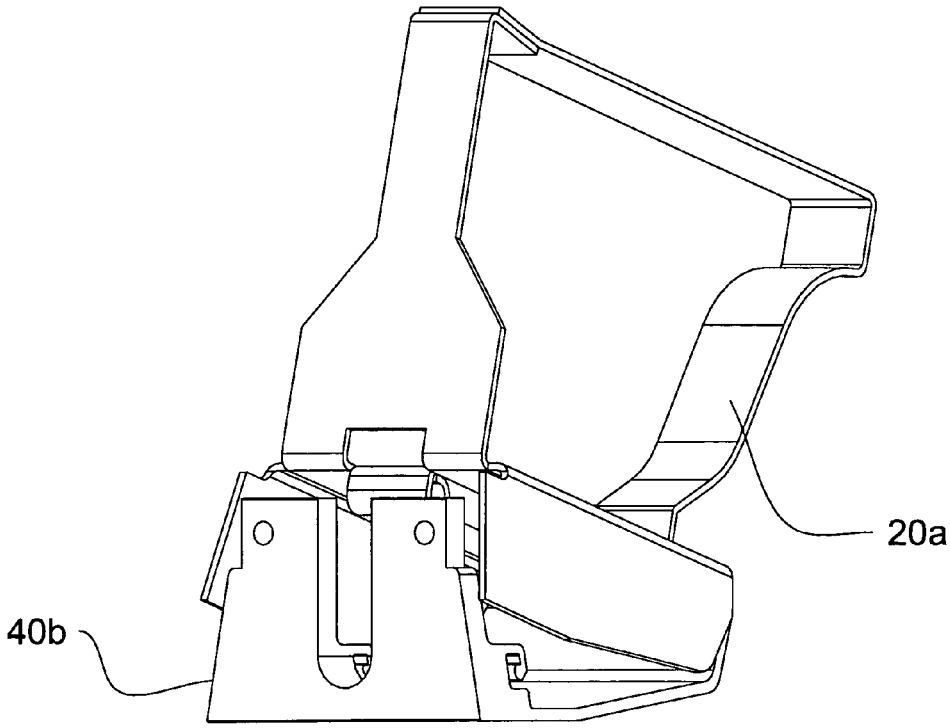

Referring to the drawings, FIGS. 1–12, a gutter emptying system is shown. FIG. 1 shows a perspective view of the rear of the system in it's partially tilted position for emptying with downspout drain detail, FIG. 2 shows the bracket for holding the gutter in the receiving position, FIG. 3 shows the system in it's partially tilted position, FIG. 4 shows the bracket per se, FIG. 5 is a second embodiment of the bracket housing, FIG. 6 is another second embodiment of the bracket housing, FIG. 7 shows alternate form of the gutter shape to accommodate a gutter engaging bracket with a clampon to assist in holding the bracket to the gutter, FIG. 8 shows an alternate form of the gutter shape to accommodate a twist in the bracket as a second embodiment, FIG. 9 shows a second embodiment for holding an arcuate shaped gutter, FIG. 10 shows an air or liquid pressure system for activating the device, FIG. 11 shows a second embodiment of the bracket housing and a second embodiment of bracket in the fully tilted position for emptying and FIG. 12 shows an second embodiment of bracket housing and second embodiment of bracket in a nearly receiving position.

Numeral 10 designates the whole system, including a gutter 12 having an OG shape, a front 14, a back 16 and a bottom 18. Attached to the bottom 18 is a plate 20. Ends 2 and 24, on plate 20 respectively, are rolled to create rod connections. Pivotally connected to plate 20 is a hinged member 30 having hinges 32 and 34, respectively. Hinge half 28 of the hinged member has a rolled end 33 and a curved end 35. Rolled end 33 is pivotally connected to hinge half 30 of the hinged member by a pin that is integrally formed with hinge half 30. The other end of hinge half 28 with it's curved end 35 is pivotally connected in a channel 38 of a housing 40. Hinge half 30, in addition to it's integral pin 34, has an integral pin on it's other end. Hinge half 30 has a triangular shaped body 44, which provides weight to one side of hinge half 30. Half 30 has a long side "a" a short side "b" and a medium side "c". The intersection of sides "b" and "c" form an apex "d", thereby providing a weighted area ending at apex "d".

Housing 40 supports gutter 12 and houses the working parts of a gutter emptying system, which includes plate 20, hinge half 28, hinge 30 and an inflatable device 66. Housing 40 has a cavity 48 to received the aforementioned parts. The housing 40 is mounted on facia 1, as shown in FIG. 2. Housing 40 has a back vertical side 50 and a front vertical side 52. Plate 20 is connected to front vertical side 52 by pin 54. The other end 2 of plate 20, as stated, is connected to hinge half 30. The back vertical side 50 has the channel 38 integrally formed in it. Channel 38 has a J-shaped wall 56 where the free end of the J-shaped wall has a curvature 58 and an inclined surface 60. The curved end 35 of hinge half 28 is inserted in channel 38 so as to ride on curvature 58 and wall 62, when the hinge half 28 is stopped by inclined surface 60 to prevent the curvature 35 from completely coming out of channel 38.

Positioned between hinge half 28 and housing 40 are a series of inflatable bladders 66. A pair of tabs 68 and 70 are fastened to hinge half 28 and to housing 40, respectively. An inflation tube 72 is used to pump air or other fluid into bladder 66 and to remove air or other fluid. There are several apparatuses for providing air or fluid to the inflatable bladder 66. For example, containers of compressed air, pumps, etc.

In use, with the gutter 12 filled with debris, air or other fluid is pumped into inflatable bladder 66. As the bladder 66 fills with air or liquid the hinge 28 pivots about channel 38 to begin lifting the rear of gutter 12 about pivot 54. The higher the rear of gutter 12 is lifted the more the hinge halves 28 and 30 open to the position shown in FIG. 11.

After the contents of the gutter 12 are emptied, air or other fluid is released from the inflatable bladder 66. As the bladder 66 deflates, the hinge halves 28 and 30 begin to close in part to the weighted area of the hinge half 30, which continues to apply a downward force on the hinge pivot at pin 32. If liquid is used, the gravitational pull of the liquid as it flows downwardly will assist in returning the gutter to it's normal closed position.

While only one embodiment of the invention is disclosed it is understood that one skilled in the art may see other embodiments. For a full understanding of the invention, one should look to the claims, description and drawings.

It is understood that there are several embodiments of the same components as follows; item 20 and 20*a* are to accommodate commercial off the shelf "OG" style of gutter item 12; 20*b* is to accommodate commercial off the shelf "U" (or arcuate shaped style of gutter); 20*c* is used to accommodate a style of gutter identified as item 81; and 20*d* is used to accommodate a style of gutter identified as item 80. Housing 40, 40*a*, 40*b*, 40*c*, are used with other items as shown. Hinge 28 and 28*a* are to be used with there housing as shown.

The invention claimed is:

1. A gutter system for emptying gutters of debris, comprising:

a gutter support housing which is mounted to a building facia board;

plate means associated with said housing attached to a gutter where said plate means having a first end and a second end, said first end being connected to a pivoting means on said gutter housing;

a hinge means pivotally connected to said second end of said plate means, said hinge means having a first half and a second half, where said second half is connected to said second end of said plate means;

said gutter support housing having a front wall, and a back wall where said first half of said hinge means is attached and where said front wall has said pivoting means connected to said first end of said plate means; and, an inflatable bladder means in said gutter support housing between said hinge means and said gutter support housing to pivot the gutter about said pivoting means on said front wall of said gutter support housing when air or fluid is pumped into said bladder means.

2. A gutter system as in claim 1 wherein said second half of said hinge is weighted to assist in returning the gutter to its rain and debris receiving position when said bladder is deflated.

3. A gutter system as in claim 2 wherein said inflatable bladder means is connected to said first half of said hinge and to said gutter support housing.

4. A gutter system as in claim 3 wherein said inflatable bladder means has an inflation tube for connecting to a source of pressurized air or fluid.

5. A gutter system as in claim 4 wherein a channel in said back wall of said gutter support housing has a J-shaped wall to receive a curved end on said first half of said hinge and to prevent said curved end from separating from said channel.

6. A gutter system as in claim 4 in which the deflation of the bladder pulls the hinge and the gutter partly into the closed debris receiving position, then the weighted second half of said hinge means takes over and completes the closing of the gutter into its rain and debris receiving position.

7. A gutter support housing as in claim 4 formed to mate with a clampon style of bracket.

8. A gutter system as in claim 3 in which the inflatable bladder means is resilient and assists in returning the gutter to its normal rain and debris receiving position when said bladder is deflated.

9. A gutter support housing as in claim 1 in which said gutter support housing is adapted to support a gutter having its rolled outside edge rolled closed.

10. A gutter support housing as in claim 1 in which the support housing is formed to engage a twist in style of bracket.

11. A gutter support system as in claim 1 in which downward gravitational flow of a liquid, when used, assists in returning the gutter housing and the gutter to its normal closed position.

* * * * *